US007880707B2

(12) United States Patent
Yang et al.

(10) Patent No.: US 7,880,707 B2
(45) Date of Patent: Feb. 1, 2011

(54) LIQUID CRYSTAL MODULE HAVING STORING MEMBER FOR CONTROLLING WORKING MODE OF DRIVING CHIP THEREOF

(75) Inventors: Bin Yang, Shenzhen (CN); Gang-Qiang Zheng, Shenzhen (CN); Jian-Ying Lan, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 642 days.

(21) Appl. No.: 12/005,714

(22) Filed: Dec. 28, 2007

(65) Prior Publication Data

US 2009/0128468 A1 May 21, 2009

(30) Foreign Application Priority Data

Dec. 29, 2006 (TW) ..... 95149680 A

(51) Int. Cl.
*G09G 3/36* (2006.01)

(52) U.S. Cl. ..... 345/90; 345/87

(58) Field of Classification Search ..... 345/97, 345/90, 92, 98–100, 103, 204
See application file for complete search history.

(56) References Cited

U.S. PATENT DOCUMENTS

| | | | | |
|---|---|---|---|---|
| 5,298,915 | A * | 3/1994 | Bassetti, Jr. | 345/696 |
| 7,012,667 | B2 | 3/2006 | Pai | |
| 7,646,397 | B2 * | 1/2010 | Karaki | 345/690 |
| 2007/0155418 | A1 * | 7/2007 | Shau et al. | 455/550.1 |

* cited by examiner

*Primary Examiner*—Ricardo L Osorio
(74) *Attorney, Agent, or Firm*—Wei Te Chung

(57) ABSTRACT

An exemplary liquid crystal module (20) includes liquid crystal panel (200) and a driving chip (210). The driving chip includes an interface circuit (230), a storing member (260), and a plurality of input ports. The plurality of input ports are configured for receiving display data. The storing member and the interface circuit share at least one common input port of the plurality of input ports. The storing member receives at least one mode selection signal for controlling a working mode of the driving chip via the at least one common input port in a first period of time. The storing member outputs the at least one mode selection signal to the interface circuit, and then the interface circuit receives the display data via the plurality of input ports including the at least one common input port according to the working mode in a second period of time.

20 Claims, 2 Drawing Sheets

LIQUID CRYSTAL MODULE HAVING STORING MEMBER FOR CONTROLLING WORKING MODE OF DRIVING CHIP THEREOF

FIELD OF THE INVENTION

The present invention relates to liquid crystal modules, and more particularly to a liquid crystal module having a storing member for controlling a working mode of a driving chip thereof.

GENERAL BACKGROUND

Liquid crystal displays are widely used in modem display devices due to their advantages such as portability, low power consumption, and low radiation. Generally, a liquid crystal display includes a liquid crystal module, and a backlight module for providing light beams to illuminate the liquid crystal module.

FIG. 3 is an abbreviated plan view of a conventional liquid crystal module. The liquid crystal module 10 includes a liquid crystal panel 100, a driving chip 110, and a flexible printed circuit 170. The liquid crystal panel 100 includes a main central display area 101, and a peripheral non-display area (not labeled) surrounding the display area 101. The display area 101 is where images are displayed by the liquid crystal module 10. The driving chip 110 is configured to drive the liquid crystal panel 100 to work, and is disposed at the non-display area. The flexible printed circuit 170 includes a plurality of electrical lines 173 disposed therein. The electrical lines 173 are electrically coupled to the driving chip 110, and are configured for transmitting digital data from a data source (not shown) to the driving chip 110.

FIG. 4 is an abbreviated circuit diagram of the driving chip 110 and the flexible printed circuit 170. The driving chip 110 includes a timing control circuit 140 and an interface circuit 130. The timing control circuit 140 is configured to control displaying of images on the liquid crystal panel 100, and is electrically coupled to the interface circuit 130. The interface circuit 130 is configured to receive the digital data transmitted via the electrical lines 173 of the flexible printed circuit 170. The interface circuit 130 includes a mode selection portion 135 and a plurality of display data input terminals D1~Dn. The mode selection portion 135 includes a first mode selection terminal 131, a second mode selection terminal 132, a third mode selection terminal 133, and a fourth mode selection terminal 134. The mode selection terminals 131, 132, 133, 134 are used to receive digital codes which determine a working mode of the driving chip 110. The display data input terminals D1~Dn are used to receive display data according to the working mode. Moreover, each of the mode selection terminals 131, 132, 133, 134 and the display data input terminals D1~Dn corresponds to a respective pin of the driving chip 110. That is, the driving chip 110 includes n+4 pins that are used for receiving digital data.

In operation, the first mode selection terminal 131, the second mode selection terminal 132, the third mode selection terminal 133, and the fourth mode selection terminal 134 respectively receive a first mode selection signal IM0, a second mode selection signal IM1, a third mode selection signal IM2, and a fourth mode selection signal IM3 simultaneously. Each of the mode selection signals IM0, IM1, IM2, IM3 is a 1-bit binary code, and thereby a 4-bit binary code is inputted to the mode selection portion 135. The 4-bit binary code determines the working mode of the driving chip 110. The driving chip 110 then receives the display data via the display data input terminals D~Dn according to the working mode. Relationships between the 4-bit binary code and the working mode of the driving chip 110 are shown in the following table:

| IM0 | IM1 | IM2 | IM3 | WORKING MODE |
|---|---|---|---|---|
| 0 | 0 | 0 | 0 | 16-bit interface, 68-system |
| 1 | 0 | 0 | 0 | 8-bit interface, 68-system |
| 0 | 1 | 0 | 0 | 16-bit interface, 80-system |
| 1 | 1 | 0 | 0 | 8-bit interface, 80-system |
| 1 | 0 | 1 | 0 | Serial Peripheral Interface (SPI) |
| 0 | 1 | 1 | 0 | Setting Disabled |
| 0 | 0 | 0 | 1 | 18-bit interface, 68-system |
| 1 | 0 | 0 | 1 | 9-bit interface, 68-system |
| 0 | 1 | 0 | 1 | 18-bit interface, 80-system |
| 1 | 1 | 0 | 1 | 9-bit interface, 80-system |
| * | * | 1 | 1 | Setting Disabled |

In the table, an asterisk means either 0 or 1. As shown in the table, each 4-bit binary code corresponds to a working mode of the driving chip 110. For example, when the mode selection signals IM0, IM1, IM2, IM3 are respectively 0, 1, 0, 0, the 4-bit binary code is 0100, and the 4-bit binary code controls the driving chip 110 to select a working mode of 16-bit interface, 80-system. That is, the 4-bit binary code controls the driving chip 110 to instruct the interface circuit 130 to employ a so-called 16-bit interface mode to receive display data, and instruct the interface circuit 130 to receive the display data according to a so-called 80-system timing protocol. The display data is then transmitted to the timing control circuit 140 by the interface circuit 130. The timing control circuit 140 generates timing signals therein according to the display data, and outputs the timing signals and the display data to the liquid crystal panel 100. The liquid crystal panel 100 then displays images representing the display data according to the timing signals.

In the liquid crystal module 10, the working mode of the driving chip 110 is determined by the 4-bit binary code that is received by the mode selection portion 135 of the interface circuit 130. Because the 4-bit binary code is inputted to the interface circuit 130 via the mode selection terminals 131, 132, 133, 134, and these mode selection terminals 131, 132, 133, 134 respectively receive the mode selection signals IM0, IM1, IM2, IM3 transmitted via the electrical lines 173 of the flexible printed circuit 170 simultaneously, at least four mode selection terminals 131, 132, 133, 134 are necessary for forming the mode selection portion 135. That is, the driving chip 110 needs at least n+4 pins to receive digital data from the data source, with four pins thereof being used to receive the mode selection signals IM0, IM1, IM2, IM3, and n pins thereof being used to receive the display data. The four pins corresponding to the mode selection terminals 131, 132, 133, 134 cause a size of the driving chip 110 to be correspondingly large. This in turn means the driving chip 110 requires a large amount of space for bonding to the non-display area of the liquid crystal panel 100. That is, the liquid crystal panel 100 needs a large space for bonding of the driving chip 110 thereon. This limits the compactness and portability of the liquid crystal module 10.

It is, therefore, desired to provide a liquid crystal module which overcomes the above-described deficiencies.

SUMMARY

In a first aspect, a liquid crystal module includes liquid crystal panel and a driving chip. The driving chip is configured for driving the liquid crystal panel to function, and includes an interface circuit, a storing member, and a plurality of input ports. The plurality of input ports are configured for receiving display data. The storing member and the interface circuit share at least one common input port of the plurality of input ports. The storing member receives at least one mode selection signal via the at least one common input port in a first period of time. The at least one mode selection signal is configured for controlling a working mode of the driving chip. The storing member outputs the at least one mode selection signal to the interface circuit, and then the interface circuit receives the display data via the plurality of input ports including the at least one common input port according to the working mode in a second period of time.

In a second aspect, a liquid crystal panel and a driving chip configured for driving the liquid crystal panel. The driving chip includes an interface circuit, a storing member, and a plurality of input ports. The storing member receives one or more mode selection signals from one or more of the plurality of input ports, and stores the one or more mode selection signals therein. The interface circuit receives the one or more mode selection signals from the storing member. The one or more mode selection signals determine a working mode of the driving chip, and then the interface circuit receives display data from the plurality of input ports according to the working mode of the driving chip.

In a third aspect, a liquid crystal panel and a driving chip configured for driving the liquid crystal panel. The driving chip includes an interface circuit, a storing member, and a plurality of input ports. One of the n+1 pins is configured for transmitting a control signal to the storing member. The other n pins are configured for transmitting display data to the interface circuit. At least one of the n pins is configured for also transmitting at least one mode selection signal to the storing member, and the control signal is used to determine a working state of the storing member such that when the control signal activates the storing member. Said at least one of the n pins transmits the at least one mode selection signal to the storing member in a first period of time, the storing member transmits the at least one mode selection signal to the interface circuit. The at least one mode selection signal determines a working mode of the driving chip, and then the interface circuit receives the display data via the n pins according to the working mode in a second period of time.

Other novel features and advantages will become more apparent from the following detailed description when taken in conjunction with the accompanying drawings. In the drawings, all the views are schematic.

DETAILED DESCRIPTION OF PREFERRED EMBODIMENTS

Reference will now be made to the drawings to describe preferred and exemplary embodiments of the present invention in detail.

Figure 1:
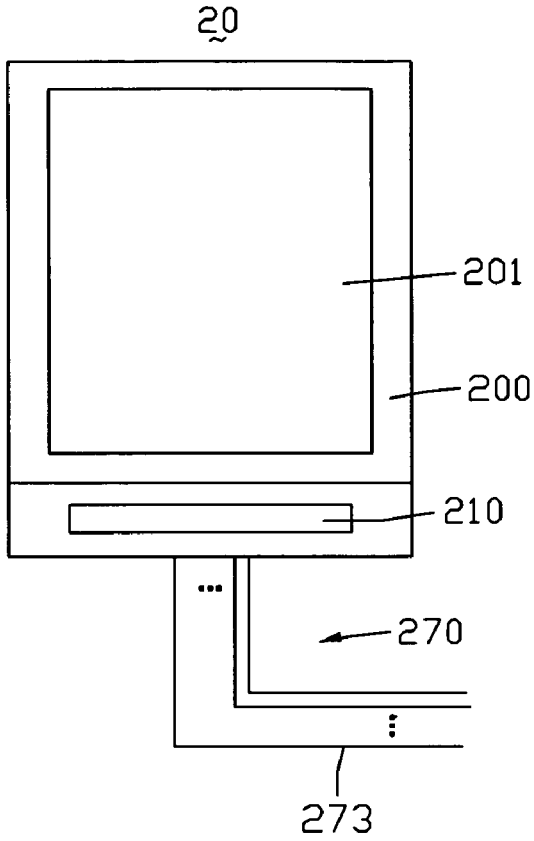
FIG. 1 is an abbreviated plan view of a liquid crystal module according to an exemplary embodiment of the present invention, the liquid crystal module including a driving chip.

FIG. 1 is an abbreviated plan view of a liquid crystal module according to an exemplary embodiment of the present invention. The liquid crystal module 20 includes a liquid crystal panel 200, a driving chip 210, and a flexible printed circuit 270. The liquid crystal panel 200 includes a main central display area 201, and a peripheral non-display area (not labeled) surrounding the display area 201. The display area 201 is where images are displayed by the liquid crystal module 20. The driving chip 210 is configured to drive the liquid crystal panel 200 to work, and is disposed at the non-display area. In particular, the driving chip 210 is bonded at the non-active of the liquid crystal panel 200 via so-called chip on glass (COG) technology. The flexible printed circuit 270 includes a plurality of electrical lines 273 disposed therein. The electrical lines 273 are electrically coupled to the driving chip 210, and are configured for transmitting digital data from a data source (not shown) to the driving chip 210.

Figure 2:
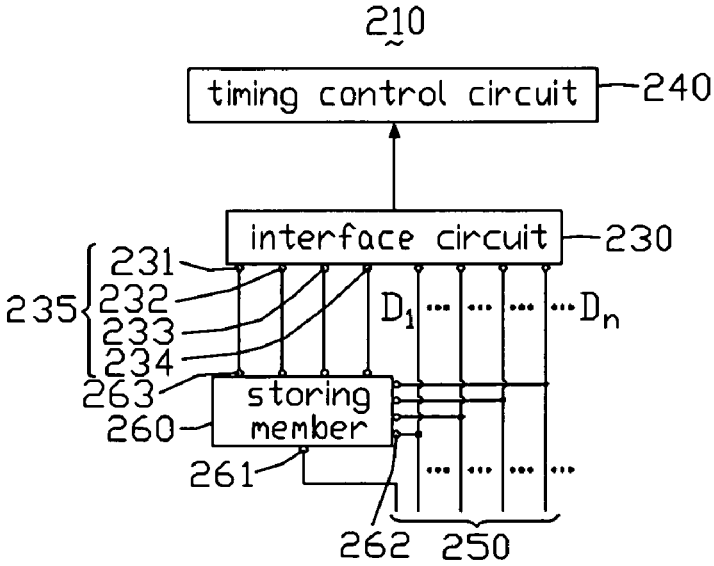
FIG. 2 is an abbreviated circuit diagram of the driving chip of the liquid crystal module of FIG. 1.
Figure 3:
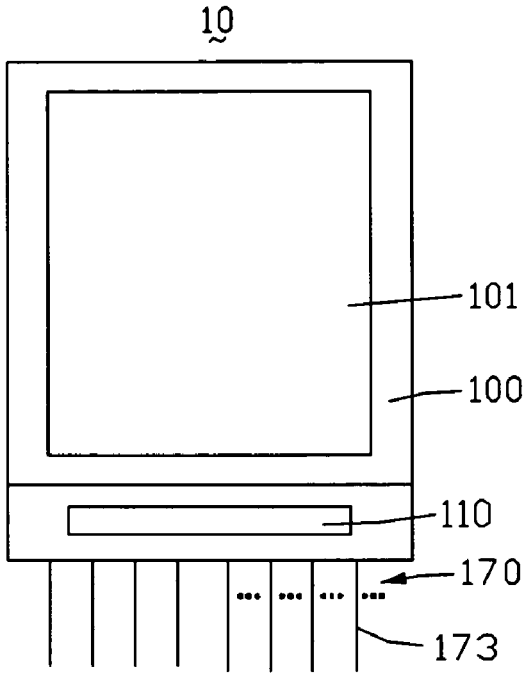
FIG. 3 (RELATED ART)
FIG. 3 is an abbreviated plan view of a conventional liquid crystal module, the liquid crystal module including a driving chip and a flexible printed circuit.
Figure 4:
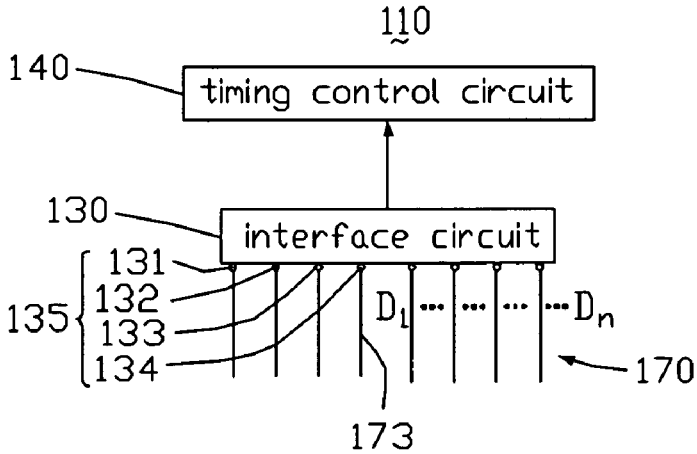
FIG. 4 (RELATED ART)
FIG. 4 is an abbreviated circuit diagram of the driving chip and the flexible printed circuit of the liquid crystal module of FIG. 3.

FIG. 2 is an abbreviated circuit diagram of the driving chip 210. The driving chip 210 includes a timing control circuit 240, an interface circuit 230, a storing member 260, and a data input portion 250.

The data input portion 250 includes a plurality of input ports (not labeled). The input ports are used to receive the digital data, and each of the input ports is electrically coupled to a corresponding electrical line 273 of the flexible printed circuit 270. Moreover, the digital data received by the data input portion 250 include mode selection signals for determining a working mode of the driving chip 210, and display data for displaying images.

The interface circuit 230 includes a plurality of display data input terminals D1~Dn, and a mode selection portion 235. The display data input terminals D1~Dn are used to receive the display data. Each of the display data input terminals D1~Dn is electrically coupled to a corresponding input port of the data input portion 250. The mode selection portion 235 is used to receive the mode selection signals, and includes a first mode selection terminal 231, a second mode selection terminal 232, a third mode selection terminal 233, and a fourth mode selection terminal 234. The mode selection terminals 231, 232, 233, 234 are electrically coupled to the storing member 260.

The storing member 260 is configured to store the mode selection signals, and can be a register that is capable of storing 4-bit digital data. The storing member 260 includes a control terminal 261, four input terminals 262, and four output terminals 263.

The control terminal 261 is configured to control a working state of the storing member 260 via applying a control signal, and is electrically coupled a corresponding input port of the data input portion 250.

The input terminals 262 are configured to receive the mode selection signals, and each of the input terminals 262 is respectively electrically coupled to a corresponding one of four selected input ports of the data input portion 250. Each of the selected input ports serves as a common input port to transmit digital data for the input terminal 262 and a corresponding one of the display data input terminals D1~D4. In particular, each common input port is electrically coupled to both a corresponding input terminal 262 and a corresponding one of the display data input terminals D1~D4. The input terminal 262 uses the common input port for receiving a mode selection signal, and the display data input terminal D1, D2, D3, or D4 uses the common input port for receiving display data.

The output terminals 263 are configured to output the mode selection signals from the storing member 260 to the mode selection portion 235 of the interface circuit 230. Each of the output terminals 263 is electrically coupled to a corresponding one of the mode selection terminals 231, 232, 233, 234.

The timing control circuit 240 is configured to control the displaying of images on the liquid crystal panel 200, and is electrically coupled to the interface circuit 230.

In operation, the control terminal 261 of the storing member 260 receives a first control signal from the corresponding input port of the data input portion 250. The first control signal is a high voltage signal. This high voltage signal switches the storing member 260 to be in a writable state, so as to enable the input terminals 262 of the storing member 260 to receive signals. A first mode selection signal IM0, a second mode selection signal IM1, a third mode selection signal IM2, and a fourth mode selection signal IM3 are then respectively written into the storing member 260 via the corresponding input terminals 262. Each of the mode selection signals IM0, IM1, IM2, IM3 is a 1-bit binary code. Thereby, a 4-bit binary code is written into and stored in the storing member 260.

Then a second control signal is applied to the control terminal 261 of the storing member 260 via the data input portion 250. The second control signal is a low voltage signal. This low voltage signal switches the storing member 260 to be in a readable state. Thus the mode selection signals IM0, IM1, IM2, IM3 stored in the storing member 260 can be read by the interface circuit 230. In addition, the low voltage signal also disables the input terminals 262 of the storing member 260 from receiving signals. Then the mode selection signals IM0, IM1, IM2, IM3 are respectively outputted by the storing member 260 via the corresponding output terminals 263, and are received by the mode selection terminals 231, 232, 233, 234 of the interface circuit 230. The 4-bit binary code defined by the mode selection signals IM0, IM1, IM2, IM3 determines a working mode of the driving chip 210. The driving chip 210 then receives the display data via the display data input terminals D1~Dn according to the working mode. In particular, relationships between the 4-bit binary code and the working mode of the driving chip 210 are shown in the following table:

| IM0 | IM1 | IM2 | IM3 | WORKING MODE |
|---|---|---|---|---|
| 0 | 0 | 0 | 0 | 16-bit interface, 68-system |
| 1 | 0 | 0 | 0 | 8-bit interface, 68-system |
| 0 | 1 | 0 | 0 | 16-bit interface, 80-system |
| 1 | 1 | 0 | 0 | 8-bit interface, 80-system |
| 1 | 0 | 1 | 0 | Serial Peripheral Interface (SPI) |
| 0 | 1 | 1 | 0 | Setting Disabled |
| 0 | 0 | 0 | 1 | 18-bit interface, 68-system |
| 1 | 0 | 0 | 1 | 9-bit interface, 68-system |
| 0 | 1 | 0 | 1 | 18-bit interface, 80-system |
| 1 | 1 | 0 | 1 | 9-bit interface, 80-system |
| * | * | 1 | 1 | Setting Disabled |

In the table, an asterisk means either 0 or 1. As shown in the table, each 4-bit binary code corresponds to a working mode of the driving chip 210. For example, if the mode selection signals IM0, IM1, IM2, IM3 are 0, 1, 0, 0, respectively, the 4-bit binary code is 0100, and the 4-bit binary code controls the driving chip 210 to select a working mode of 16-bit interface, 80-system. That is, the 4-bit binary code controls the driving chip 210 to instruct the interface circuit 230 to employ a so-called 16-bit interface mode to receive the display data, and the display data is received by the interface circuit 230 via the display data input terminals D1~D16. Moreover, the 4-bit binary code also controls the driving chip 210 to instruct the interface circuit 230 to receive the display data according to a so-called 80-system timing protocol.

The display data is then outputted to the timing control circuit 240 by the interface circuit 230. The timing control circuit 240 generates timing signals therein according to the display data. The timing signals and the display data are then outputted to the liquid crystal panel 200 by the timing control circuit 240, and the liquid crystal panel 200 displays images representing the display data according to the timing signals.

In the liquid crystal module 20, the storing member 260 is provided to store the 4-bit binary code that is used to determine the working mode of the driving chip 210, and a control signal is applied to the storing member 260 for controlling the working state of the storing member 260. The 4-bit binary code is written to the storing member 260 via the input terminals 262 thereof when the control signal is a high voltage signal, and the 4-bit binary code is outputted to the interface circuit 230 when the control signal is a low voltage signal. The driving chip 210 receives the 4-bit binary code before receiving the display data. That is, the input terminals 262 and the display data input terminals D1~Dn receive digital data in different periods of time. Thereby, each of the input terminals 262 of the storing member 260 and the corresponding display data input terminal D1, D2, D3, or D4 of the interface circuit 230 are capable of using a common input port of the data input portion 250 for receiving the digital data. Thus a total of only n+1 pins are needed in the driving chip 210 to receive the digital data from the data source, with one of the pins being used to receive the control signal, and the n pins being used to receive the display data as well as the mode selection signals IM0, IM1, IM2, IM3. Accordingly, a size of the driving chip 210 can be reduced, and the space of the non-display area of the liquid crystal panel 200 where the driving chip 210 is bonded can also be reduced. Therefore, the compactness and portability of the liquid crystal module 20 is improved.

It is to be further understood that even though numerous characteristics and advantages of preferred and exemplary embodiments have been set out in the foregoing description, together with details of the structures and functions of the embodiments, the disclosure is illustrative only; and that changes may be made in detail within the principles of the present invention to the full extent indicated by the broad general meaning of the terms in which the appended claims are expressed.

What is claimed is:

1. A liquid crystal module, comprising:

a liquid crystal panel; and a driving chip configured for driving the liquid crystal panel, the driving chip comprising an interface circuit, a storing member, and a plurality of input ports;

wherein the plurality of input ports are configured for receiving display data, the storing member and the interface circuit share at least one common input port of the plurality of input ports, the storing member receives at least one mode selection signal via the at least one common input port in a first period of time, the at least one mode selection signal is configured for controlling a working mode of the driving chip, the storing member outputs the at least one mode selection signal to the interface circuit, and then the interface circuit receives the display data via the plurality of input ports including the at least one common input port according to the working mode in a second period of time.

2. The liquid crystal module as claimed in claim 1, wherein the storing member is a register.

3. The liquid crystal module as claimed in claim 1, wherein the storing member comprises at least one input terminal configured to receive the at least one mode selection signal, and the at least one input terminal is electrically coupled to at least one common input port.

4. The liquid crystal module as claimed in claim 3, wherein the storing member further comprises a control terminal, the control terminal is configured for receiving a control signal that is used to control a working state of the storing member, the control terminal is electrically coupled to one of the input ports.

5. The liquid crystal module as claimed in claim 3, wherein the storing member receives the at least one mode selection signal via the at least one input terminal thereof when a first control signal is applied to the control terminal.

6. The liquid crystal module as claimed in claim 5, wherein the first control signal is a high voltage signal.

7. The liquid crystal module as claimed in claim 6, wherein the storing member outputs the at least one mode selection signal to the interface circuit when a second control signal is applied to the control terminal.

8. The liquid crystal module as claimed in claim 7, wherein the second control signal is a low voltage signal.

9. The liquid crystal module as claimed in claim 3, wherein at least one input terminal comprises four input terminals.

10. The liquid crystal module as claimed in claim 9, wherein the storing member further comprises four output terminals, the interface circuit comprises four mode selection terminals, and each of the mode selection terminals of interface circuit is electrically coupled to a corresponding output terminal of the storing member.

11. The liquid crystal module as claimed in claim 3, wherein the interface circuit further comprises a plurality of display data input terminals configured for receiving the display data, and each of the display data input terminals is electrically coupled to a corresponding input port of the driving chip.

12. The liquid crystal module as claimed in claim 11, wherein the at least one common input port comprises four common input ports, the at least one input terminal of the storing member comprises four input terminals, and each of the common input ports is electrically coupled to both the corresponding input terminal of the storing member and the corresponding one of the display data input terminals of the interface circuit.

13. The liquid crystal module as claimed in claim 1, wherein the at least one mode selection signal is four mode selection signals, and the four mode selection signals cooperatively form a 4-bit binary code.

14. The liquid crystal module as claimed in claim 13, wherein the 4-bit binary code determines one of an interface mode and a timing mode of the driving chip.

15. A liquid crystal module, comprising:

a liquid crystal panel; and a driving chip configured for driving the liquid crystal panel, the driving chip comprising an interface circuit, a storing member, and a plurality of input ports;

wherein the storing member receives one or more mode selection signals from one or more of the plurality of input ports, and stores the one or more mode selection signals therein, the interface circuit receives the one or more mode selection signals from the storing member, the one or more mode selection signals determine a working mode of the driving chip, and then the interface circuit receives display data from the plurality of input ports according to the working mode of the driving chip.

16. The liquid crystal module as claimed in claim 15, wherein one or more selected input ports are configured for transmitting the one or more mode selection signals to the storing member, and are also configured for transmitting corresponding portions of the display data to the interface circuit.

17. The liquid crystal module as claimed in claim 15, wherein the storing member comprises a register.

18. The liquid crystal module as claimed in claim 17, wherein the register further comprises a control terminal for controlling a working state of the storing member.

19. The liquid crystal module as claimed in claim 18, wherein the control terminal controls the storing member to receive the one or more mode selection signals from said one or more of the plurality of input ports, and to output the one or more mode selection signals to the interface circuit.

20. A liquid crystal module, comprising:

a liquid crystal panel; and a driving chip configured for driving the liquid crystal panel, the driving chip comprising an interface circuit, a storing member, and n+1 pins;

wherein one of the n+1 pins is configured for transmitting a control signal to the storing member, the other n pins are configured for transmitting display data to the interface circuit, at least one of the n pins is configured for also transmitting at least one mode selection signal to the storing member, and the control signal is used to determine a working state of the storing member such that when the control signal activates the storing member, said at least one of the n pins transmits the at least one mode selection signal to the storing member in a first period of time, the storing member transmits the at least one mode selection signal to the interface circuit, the at least one mode selection signal determines a working mode of the driving chip, and then the interface circuit receives the display data via the n pins according to the working mode in a second period of time.

* * * * *